US007273213B2

(12) United States Patent
Gibbons et al.

(10) Patent No.: US 7,273,213 B2
(45) Date of Patent: Sep. 25, 2007

(54) CUSTOMER INFORMATION CARD GAME

(75) Inventors: Patrick J. Gibbons, Indianapolis, IN (US); Marc J. Drizin, Noblesville, IN (US); Elizabeth Kyzr-Sheeley, Carmel, IN (US); Bradley D. Linville, Carmel, IN (US); Sonya McAllister, Del Mar, CA (US)

(73) Assignee: Walker Information, Inc., Indianapolis, IN (US)

( * ) Notice: Subject to any disclaimer, the term of this patent is extended or adjusted under 35 U.S.C. 154(b) by 0 days.

(21) Appl. No.: 10/813,817

(22) Filed: Mar. 31, 2004

(65) Prior Publication Data

US 2005/0218595 A1 Oct. 6, 2005

(51) Int. Cl.
*A63F 1/00* (2006.01)

(52) U.S. Cl. ..... 273/292; 273/293; 273/296; 273/307

(58) Field of Classification Search ..... 273/293, 273/292, 296, 307
See application file for complete search history.

(56) References Cited

U.S. PATENT DOCUMENTS 3,473,809 A 10/1969 Day
4,315,628 A * 2/1982 Balash et al. ..... 273/296
4,354,684 A 10/1982 McKinley
4,386,778 A 6/1983 Hall
4,635,939 A * 1/1987 Makow ..... 273/296
4,679,796 A 7/1987 Rein
4,741,540 A * 5/1988 Levine ..... 273/292
4,856,788 A 8/1989 Fischel
5,056,792 A 10/1991 Helweg-Larsen et al.
5,186,467 A * 2/1993 Chasin ..... 273/298
5,201,525 A * 4/1993 Castro ..... 273/293
5,205,563 A * 4/1993 Dearing ..... 273/296
5,280,916 A * 1/1994 Gleason, Jr. ..... 273/304
5,401,032 A * 3/1995 Barnhart et al. ..... 273/293
5,417,431 A * 5/1995 Gluck ..... 273/293
5,441,278 A * 8/1995 Nalder ..... 273/296
5,467,997 A * 11/1995 Bashirzadeh ..... 273/302
5,547,199 A * 8/1996 Calhoun ..... 273/299
5,632,488 A * 5/1997 Sturm et al. ..... 273/293
5,788,234 A 8/1998 Siofer
5,836,587 A * 11/1998 Druce et al. ..... 273/296
5,876,035 A 3/1999 Medina, Jr.
5,927,987 A * 7/1999 Berman ..... 434/107
6,017,034 A * 1/2000 Hennessey ..... 273/296
6,106,300 A 8/2000 Kiyosaki et al.
6,145,839 A * 11/2000 Katsion et al. ..... 273/308
6,237,915 B1 5/2001 Ledet et al.
6,375,466 B1 4/2002 Juranovic
6,402,152 B1 * 6/2002 Kutzik ..... 273/296
6,435,508 B1 * 8/2002 Tavel ..... 273/292
6,457,716 B1 * 10/2002 Johnson Prillerman ..... 273/296
6,497,410 B1 * 12/2002 Bernstein et al. ..... 273/297
6,568,681 B1 * 5/2003 Meyer ..... 273/298

(Continued)

*Primary Examiner*—Eugene Kim
*Assistant Examiner*—Dolores R. Collins
(74) *Attorney, Agent, or Firm*—Michael A. Swift; Doreen J. Gridley; Ice Miller LLP

(57) ABSTRACT

A customer information card game is disclosed. A set of game cards is provided, each game card having a face and a reverse side, each game card having printed thereon a plurality of types of customer information indicators and a customer loyalty indicator. Methods are provided for playing a game using the game cards.

20 Claims, 11 Drawing Sheets

U.S. PATENT DOCUMENTS 6,588,756 B1 * 7/2003 Hughes ..... 273/292
6,659,869 B1 * 12/2003 Akamatsu ..... 463/31
6,695,313 B1 * 2/2004 Blane ..... 273/307
6,755,419 B2 * 6/2004 Markus ..... 273/273
2002/0101036 A1 * 8/2002 Kutzik ..... 273/296
2004/0188937 A1 * 9/2004 Young ..... 273/292
2005/0130736 A1 * 6/2005 Polak et al. ..... 463/25

* cited by examiner

CUSTOMER INFORMATION CARD GAME

BACKGROUND

A significant challenge facing many companies involves how to combine and coordinate the information a company may have about its customers. Many companies are poorly equipped to use customer feedback, and many key employees of these companies lack skills in how to value different types of customer information. Consulting agencies may teach such skills in traditional and nontraditional formats.

Various games exist to teach specific concepts. For example, U.S. Pat. No. 5,056,792 discloses a game in which players simulate running a company. Other games use playing cards to teach specific information, an example of which is disclosed in U.S. Pat. No. 5,467,997. Similarly, U.S. Pat. No. 6,497,410 discloses an investment game using a set of trading cards. While each trading card of U.S. Pat. No. 6,497,410 features a unique publicly traded corporate business entity and includes printed indicia including corporate, product, service, and financial information of the business entity, the card game of this patent does not teach the importance of customer information to a company.

SUMMARY

The present invention is directed to a game or other exercise to help individuals understand the value of customer information, including customer loyalty. An individual who understands the importance of using such information is better equipped to make good business decisions. The methods of the present invention use a card game format to teach the participants to focus on certain customer information and to consider decision making using the customer information. Because the skills are presented in a card game format, participants can learn skills in an environment that is fun and has a competitive element.

According to one aspect of the invention, a set of playing cards for use in a customer information card game is provided, the set comprising a plurality of game cards, each game card having a face and a reverse side, each game card having printed thereon a plurality of types of customer information indicators and a customer loyalty indicator Illustrative customer information indicators include a revenue indicator, a repurchase indicator, a service calls indicator, and a profitability indicator. Some or all of these indicators, as well as other indicators, may be used. Illustratively, the distribution of symbols among the cards for each type of customer information indicator and for the customer loyalty indicators may be based on industry information or may be randomly provided, and each symbol and each loyalty indicator may be provided with an associated value. A score card may be provided for determining a total value for the cards held by a player. Optionally, each game card may further comprise a plurality of criteria about that respective customer printed on the reverse side. The criteria illustratively may include information on the customer name, size, industry, and location of the customer.

In another aspect of this invention, a method of playing a card game for assessing customer information is provided, the method comprising the steps of (a) providing a plurality of game cards, each game card representing a respective customer and having a plurality of types of customer information indicators and a customer loyalty indicator for that customer printed thereon, (b) dealing a selected number of the game cards to each of a group of players, (c) identifying the meaning of each of a first set of indicators for a first of the types of customer information, (d) allowing the players to discard unwanted game cards and receive a corresponding number of additional game cards, (e) identifying the meaning of each of a second set of indicators for a second of the types of customer information, (f) allowing the players to discard unwanted game cards and receive a corresponding number of additional game cards, (g) identifying the meaning of each of the customer loyalty indicators, (h) providing a score for each of the indicators of the first and second sets and for each of the customer loyalty indicators, and (i) totaling the scores for each player by totaling the score for each card held by that player to yield a total score for each player.

In yet another aspect of the present invention, a method of teaching the importance of customer loyalty to a plurality of players is provided. The method comprises the steps of providing a plurality of game cards to each of the players, each game card representing a respective customer and having a plurality of types of customer information indicators and a customer loyalty indicator for that customer printed thereon, instructing the players to make decisions to discard game cards and obtain additional game cards based on the customer information printed on each respective game card, identifying the meaning of the customer loyalty indicators printed on each respective card, and facilitating discussion about the effect of customer information and customer loyalty on the players' decision making.

The type of customer information provided may include one or more of revenue information, repurchase information, service calls information, and profitability information. Other customer information may be provided as well. Optional steps in the game include allowing each player to steal a card from another player and forming a team of the player having the highest score with the player having the lowest score by merging the cards of the player having the highest score with the player having the lowest score and allowing the team to discard half of their cards. These stealing and merging steps may occur at specific points in the game. Discussion at various steps allows the players to reflect on the decisions that they made and to learn about the decisions made by other players.

These and other advantages and features of the present invention shall hereinafter appear, and for the purposes of illustration, but not limitation, exemplary embodiments of the present invention shall hereinafter be described.

BRIEF DESCRIPTION OF THE DRAWINGS

FIG. 2*a* shows additional customer information;

DETAILED DESCRIPTION

Figure 1:
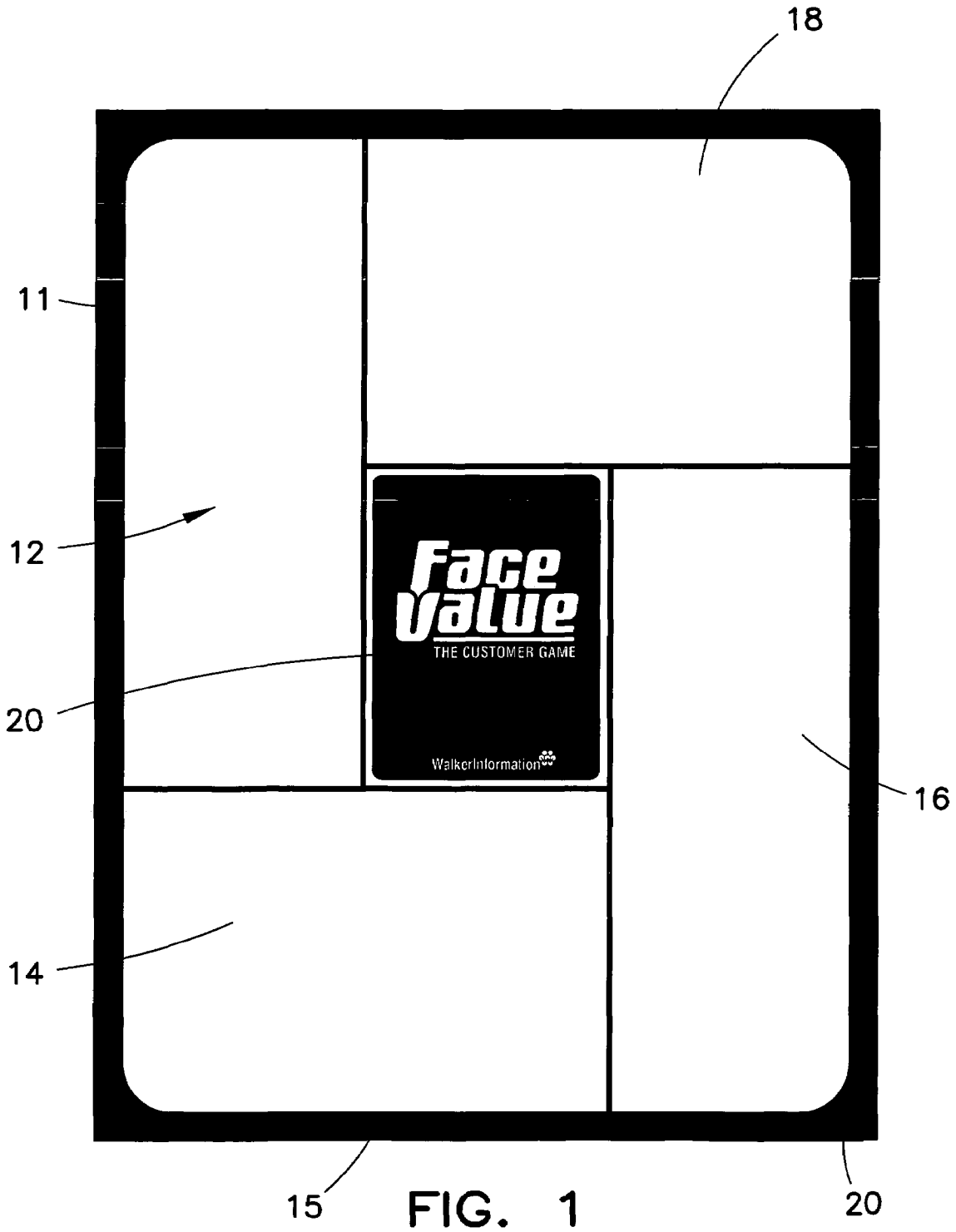
FIG. 1 is a front view of the face side of a card for the customer information card game.

One embodiment of a card for use in a customer information card game is provided as shown in FIG. 1 and is generally denoted as numeral 15. In the customer information game, each player or team of players represents a company, and each card represents a customer or potential customer. During the course of the game, each player or team receives some of the cards and has the opportunity to discard some of the cards and obtain new ones. Thus, the customer base for each company may change during the course of the game. As more information about the customer is revealed to the players, the players may obtain feedback regarding their use of customer information.

The face side 11 of playing card 15 is provided as shown in FIG. 1. The playing card 15 is illustratively a flexible card stock, as is well known in the art, but may be created from paper, wood, plastic, film, metal, or any material suitable for printing or carving. The playing card 15 may also be covered with a laminate coating or film to protect the playing card 15 and extend its useful life. In another embodiment, the playing cards may take the form of an electronic card set for a game that may be played using a computer or other electronic means. The images on the face and reverse of the card may be printed on the card, or etched or carved onto the surface of the card, or may be provided by any other means of securing an image or images to a surface. In the illustrative embodiment, the face side 11 of the card 15 comprises a first area 12, a second area 14, a third area 16, a fourth area 18, and a fifth area 20. Each of the first through fourth areas is populated with a single symbol or set of symbols, as are defined further below. The fifth area 20, shown as the border and the center of the front side of the playing card 15, is illustratively printed with one of several colors. A plurality of cards 15 printed in this way is provided as the customer information card game. The symbols in each of the first through fourth areas and the color in the fifth area 20 are varied on from card to card 15, so that cards having a number of different combinations of symbols and color are available to the players of the game. The face side 11 of the playing card 15 provides information for an individual customer—each of the five areas denotes specific facets of the customer, as will be explained in greater detail below. Thus, in the illustrated example, five areas are shown where the first through fourth areas are provided with a symbol and the fifth area is provided with a color, each providing information for the individual customer represented by the card. However, it is understood that card 15 may be provided with more or fewer areas, and that each area may be provided with its own set of symbols or colors, each to provided information about the individual customer.

Figure 3:
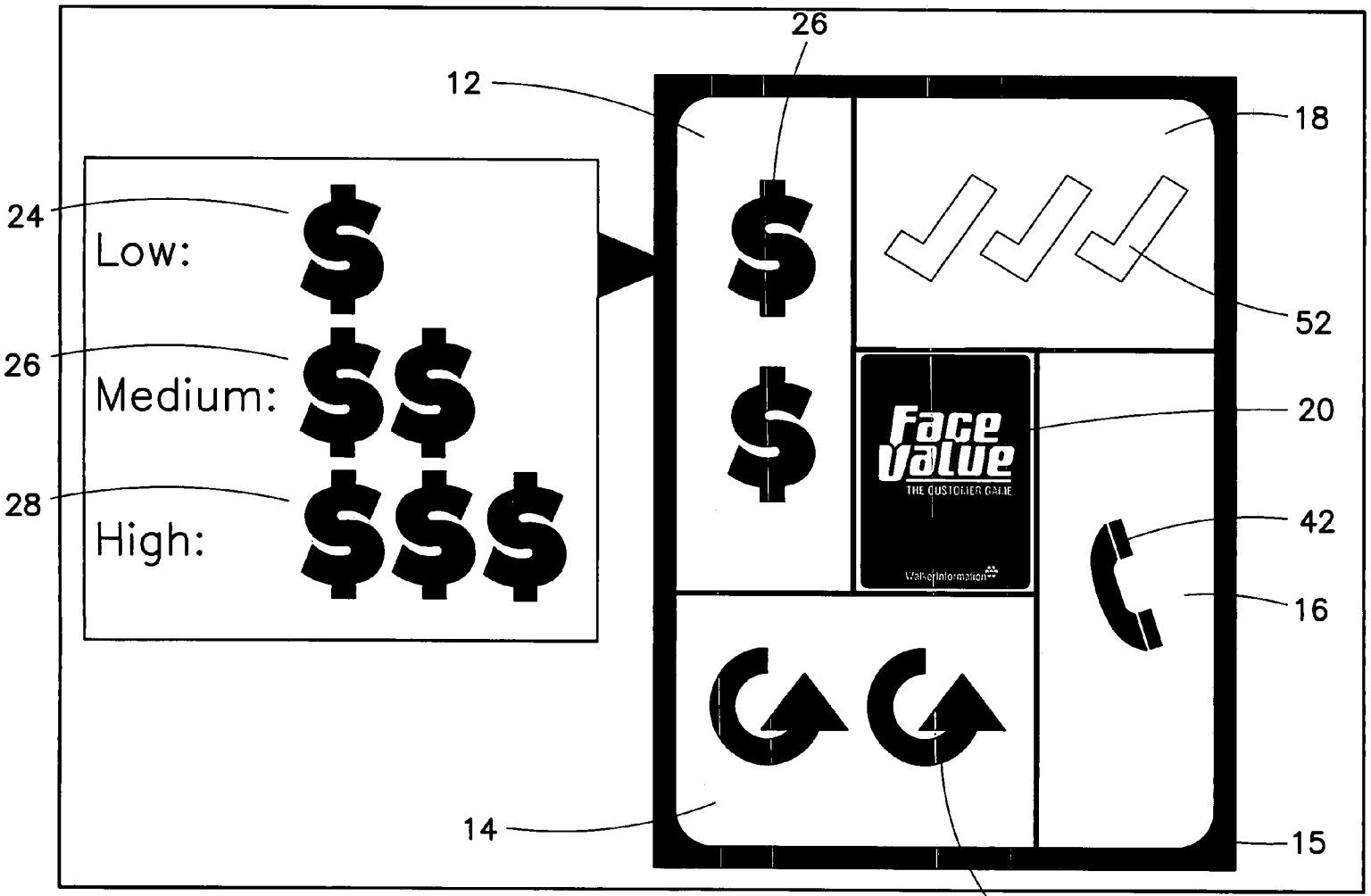
FIG. 3 is a list of symbols that may be contained in the first area of the card of FIG. 1.

Illustrative symbols for the first area 12 of the face side 11 of the playing card 15 are shown in FIG. 3. In the illustrative embodiment, the first area 12 denotes the revenue brought by the customer to the player's company. As shown, the first area 12 may be populated by between one and three dollar sign symbols, with one dollar sign 24 denoting low revenue, two dollar signs 26 denoting medium revenue, and three dollar signs 28 denoting high revenue. In the embodiment of the customer information card game provided, approximately twenty percent of the total cards contain three dollar sign symbols 28, with the fifty percent containing one dollar sign 24 and thirty percent containing two dollar sign 26 symbols. Of course, the distribution of symbols in the first area 12 is not limited to this particular distribution scheme, and may occur within a different distribution scheme, or randomly. Also, while the illustrated embodiment has three different possible revenue symbols, more or fewer revenue symbols may be used, depending on the market and desired complexity of the game.

Figure 4:
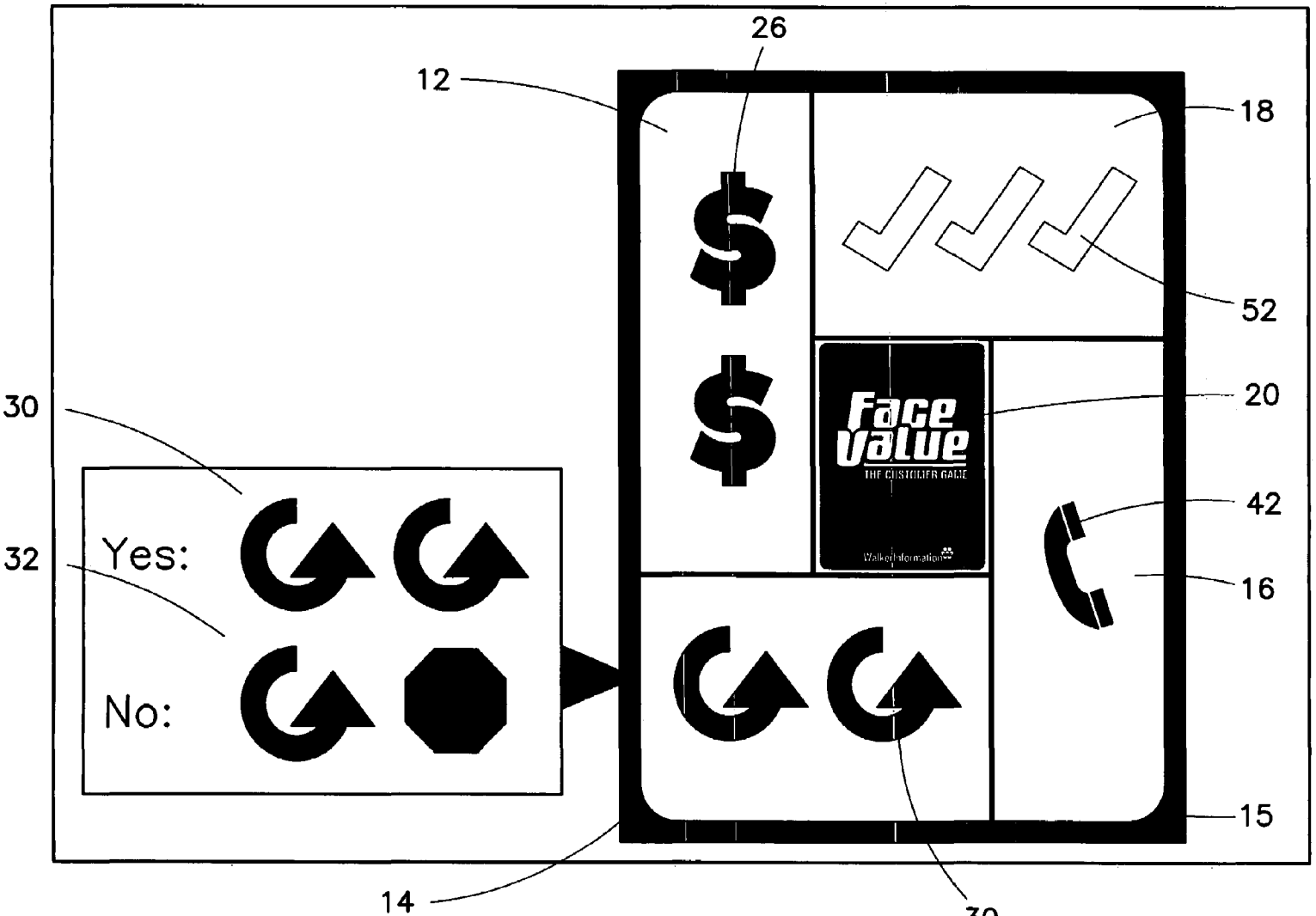
FIG. 4 is a list of symbols that may be contained in the second area of the card of FIG. 1.

Illustrative symbols for the second area 14 of the face side 11 of the playing card 15 are shown in FIG. 4. The second area 14 denotes whether the individual customer represented by playing card 15 has repurchased goods or services from the player's company within six months of the customer's initial purchase. As shown, the first area 12 may be populated by either two circular arrows 30 or by a circular arrow and a stop sign 32, with two circular arrows 30 denoting that the customer has repurchased items from the game player within six months of its initial purchase, and one circular arrow with a stop sign 32 denoting that the customer has not repurchased items from the game player within six months of its initial purchase. In the embodiment of the customer information card game provided, approximately eighty percent of the cards for high revenue customers are provided with the symbol to indicate repurchasing, while forty percent of the cards for medium revenue and thirty percent of the cards for low revenue customers are provided with the symbol to indicate repurchasing. Of course, the distribution of symbols in the second area 14 is not limited to this particular distribution scheme, and may occur within a different distribution scheme, or randomly. Also, while the illustrated embodiment has two different possible repurchase symbols, it is understood that additional re-purchase symbols may be used, illustratively indicating quantity and/or frequency of repurchasing.

Figure 5:
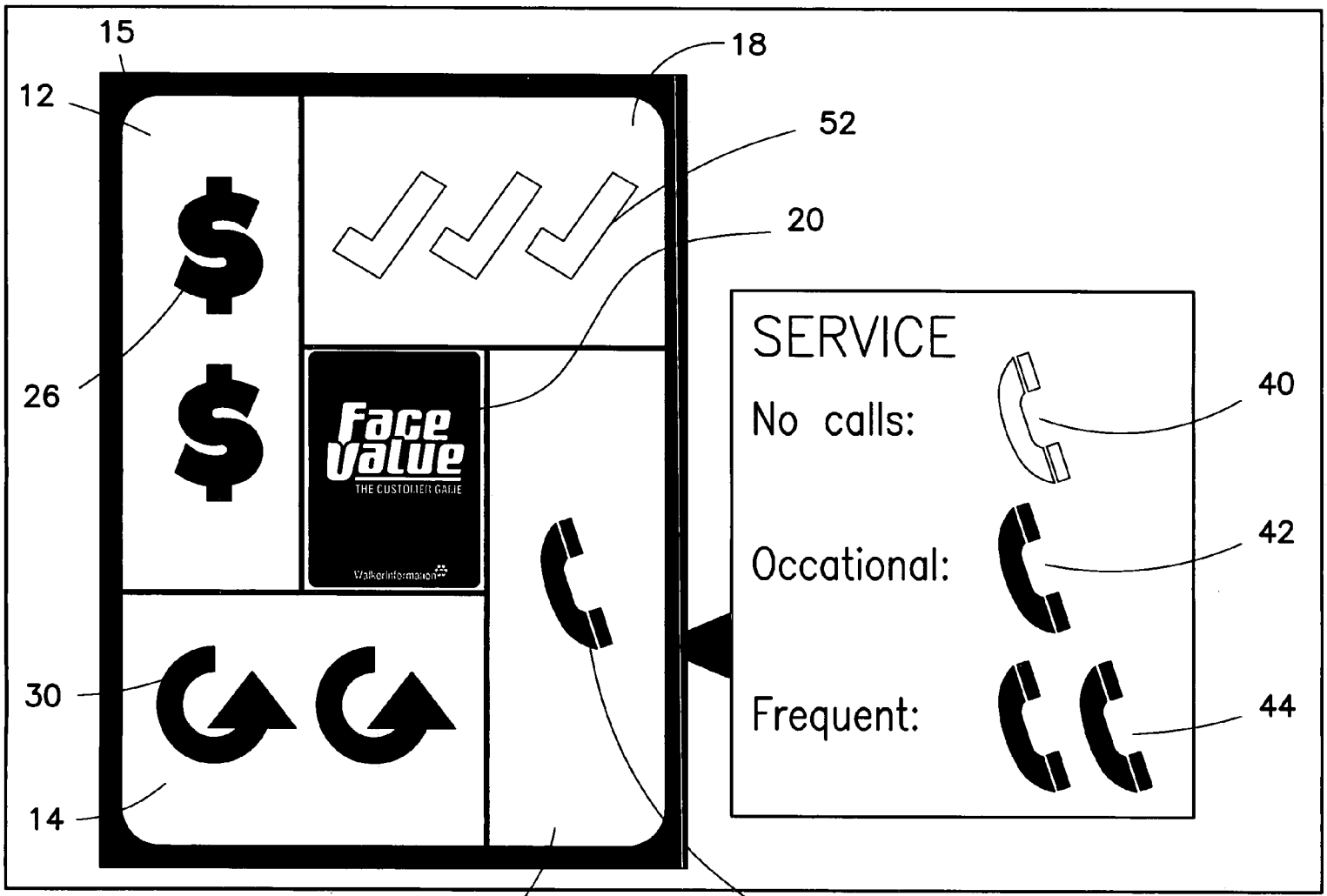
FIG. 5 is a list of symbols that may be contained in the third area of the card of FIG. 1.

Illustrative symbols for the third area 16 of the face side 11 of the playing card 15 are shown in FIG. 5. The third area 16 denotes whether the customer represented by playing card 15 has contacted the customer service center of the player's company, and also denotes how often. As shown, the third area 16 may be populated by a single stylized outline figure of a telephone handset 40, a single solid stylized figure of a telephone handset 42, or two solid stylized figures of a telephone handset 44. In this example, a single stylized outline of a telephone handset 40 denotes that the customer of playing card 15 has never contacted the game player's customer service center, a single solid stylized figure of a telephone handset 42 denotes that the customer contacts the game player's customer service center occasionally, and two solid stylized figures of a telephone handset 44 denote that the customer contacts the game player's customer service center frequently. In the embodiment of the customer information card game provided, approximately forty percent of the cards contain a single solid stylized handset 40, approximately thirty percent of the cards contain a single solid handset 42, and approximately thirty percent of the cards contain two solid handsets 44. Of course, the distribution of symbols in the third area 16 is not limited to this particular distribution scheme, and may occur within a different distribution scheme, or randomly. Also, while the illustrated embodiment has three different possible service call indicators, it is understood that more or fewer symbols may be used to represent different frequencies of calls to the game player's customer service center.

Figure 6:
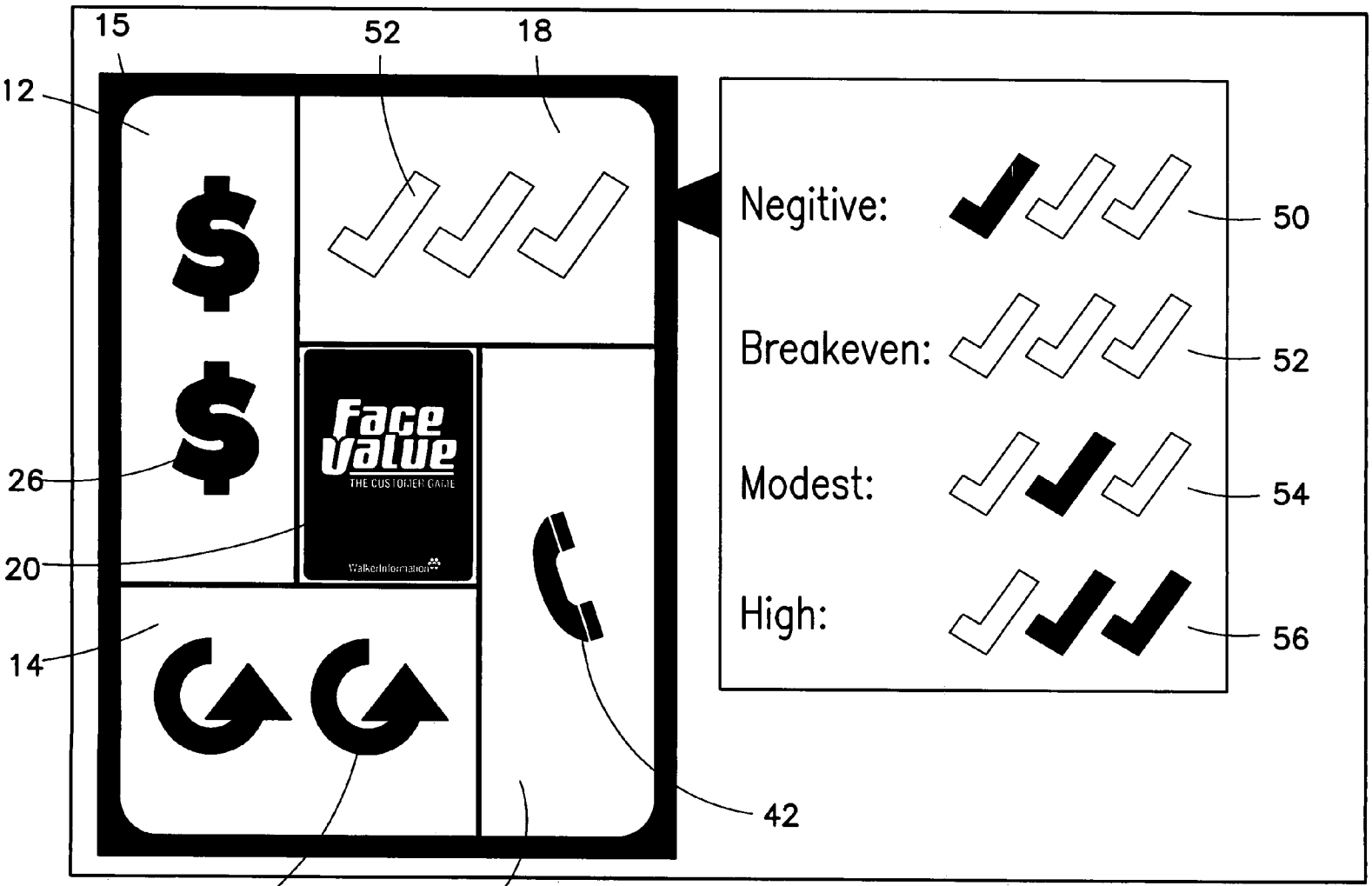
FIG. 6 is a list of symbols that may be contained in the fourth area of the card of FIG. 1.

Illustrative symbols for the fourth area 18 of the face side 11 of the playing card 15 are shown in FIG. 6. The fourth area 18 denotes the profitability of the customer represented by playing card 15. As shown, the fourth area 18 may be populated by three checkmarks, where profitability is determined by the position of open or solid checkmarks. In this example, a solid checkmark followed by two open checkmarks 50 denotes that the customer has a negative profitability, three open checkmarks 52 indicates that the customer has a breakeven profitability, an open checkmark followed by a solid checkmark followed by an open checkmark 54 indicates that the customer has a modest profitability, and an open checkmark with two solid checkmarks 56 indicates that the customer has a high profitability. In the embodiment of the customer information card game provided, twenty percent of the cards indicate a high profitability, and eighty percent of the cards are divided evenly between modest, breakeven, and negative profitability. Of course, the distribution of symbols in the fourth area 18 is not limited to this particular distribution scheme, and may occur within a different distribution scheme, or randomly. Also, while the illustrated embodiment has four different possible profitability indicators, it is understood that more or fewer symbols may be used to represent customer profitability.

The fifth area 20 of the face side 11 of the playing card 15 is shown in FIG. 1. In the illustrative example, the fifth area 20 denotes the loyalty of the customer represented by playing card 15 to the game player's company. In the present embodiment, customer loyalty is represented by one of four distinct colors. Of course, more or fewer colors may be added to indicate varying levels of loyalty. Also, it is understood that symbols may be used to indicate the various levels of loyalty instead of color, and that color may optionally represent another type of customer information. In this illustrated embodiment, a green color in the fifth area 20 indicates that the customer is very loyal (truly loyal customer), a yellow color in the fifth area 20 indicates that the customer is loyal in attitude but does not intend to repurchase (accessible customer), a blue color in the fifth area 20 indicates that the customer is not loyal, but cannot leave the relationship (trapped customer), and a red color in the fifth area 20 indicates that the customer is not loyal, and is likely to leave (high risk customer). In the illustrative embodiment of the customer information game provided, fifty-three percent of the cards contain a green color, six percent of the cards contain a yellow color, twenty-four percent of the cards contain a blue color, and seventeen percent of the cards contain a red color. Of course, the distribution of colors in the fifth area 20 is not limited to this particular distribution scheme, and may occur within a different distribution scheme, or randomly.

An illustrative card 15, having a revenue symbol 26, a repurchase symbol 30, a service call symbol 42, a profitability symbol 52, and a green loyalty color is shown in FIGS. 3-6. A plurality of such cards, each having a selected symbol representing repurchase, revenue, profitability, and service calls, and a color representing loyalty, are used for the illustrative customer information card game. Illustratively, the card game includes about 100 cards, but more or fewer cards may be used, depending on the number of players and other factors.

Figure 2:
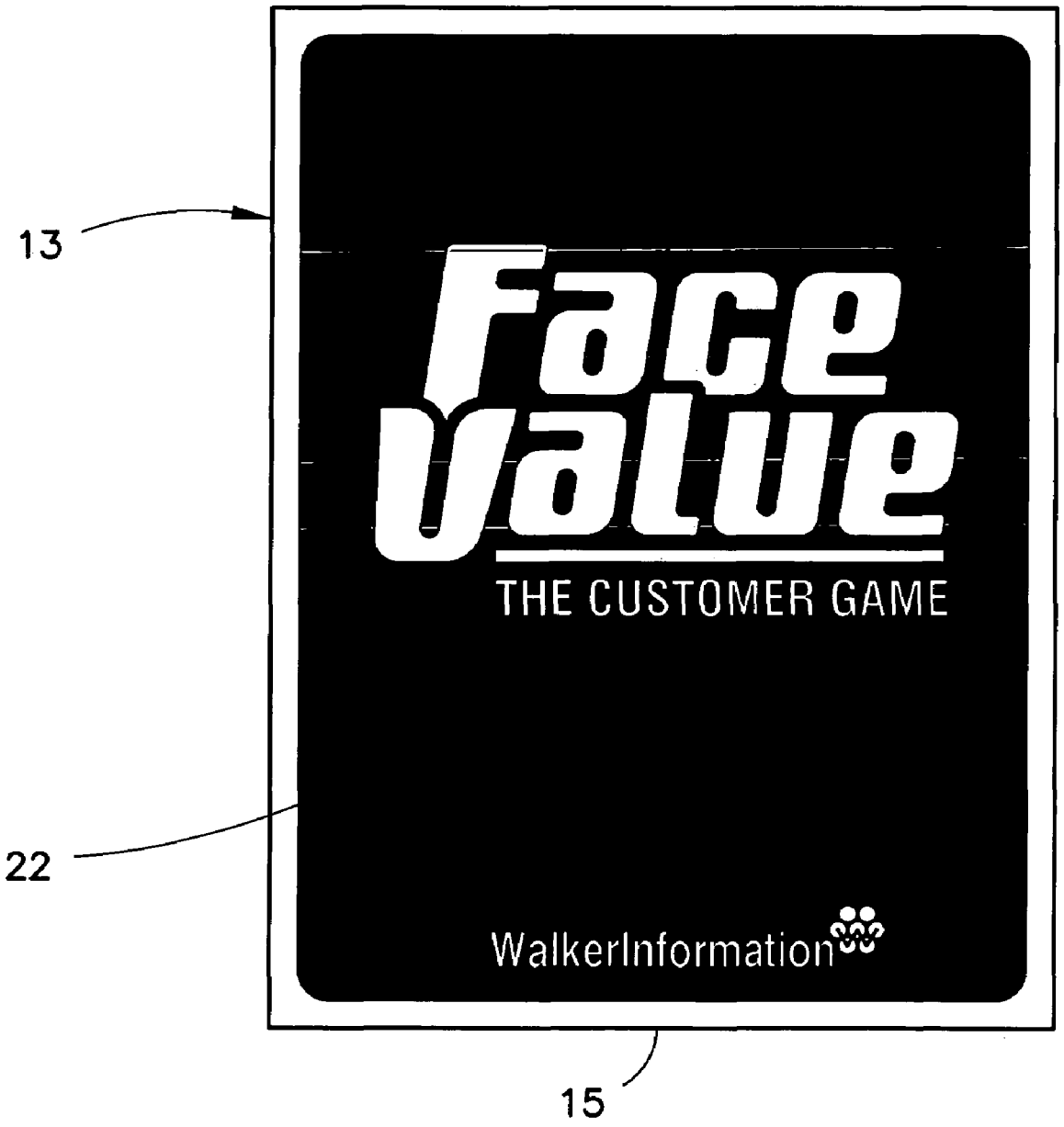
FIG. 2 is the reverse view of the card of FIG. 1.

An illustrative reverse side 13 of the playing card 15 is provided as shown in FIG. 2. The reverse image 22 is not required for game play, and may be blank or contain any image desirable. The reverse image 22 is applied to the card using any means available in the art for securing an image onto a surface. Illustratively, the image 22 provided on the reverse side 13 is the same on all cards used in the customer information card game.

Figure 2A:
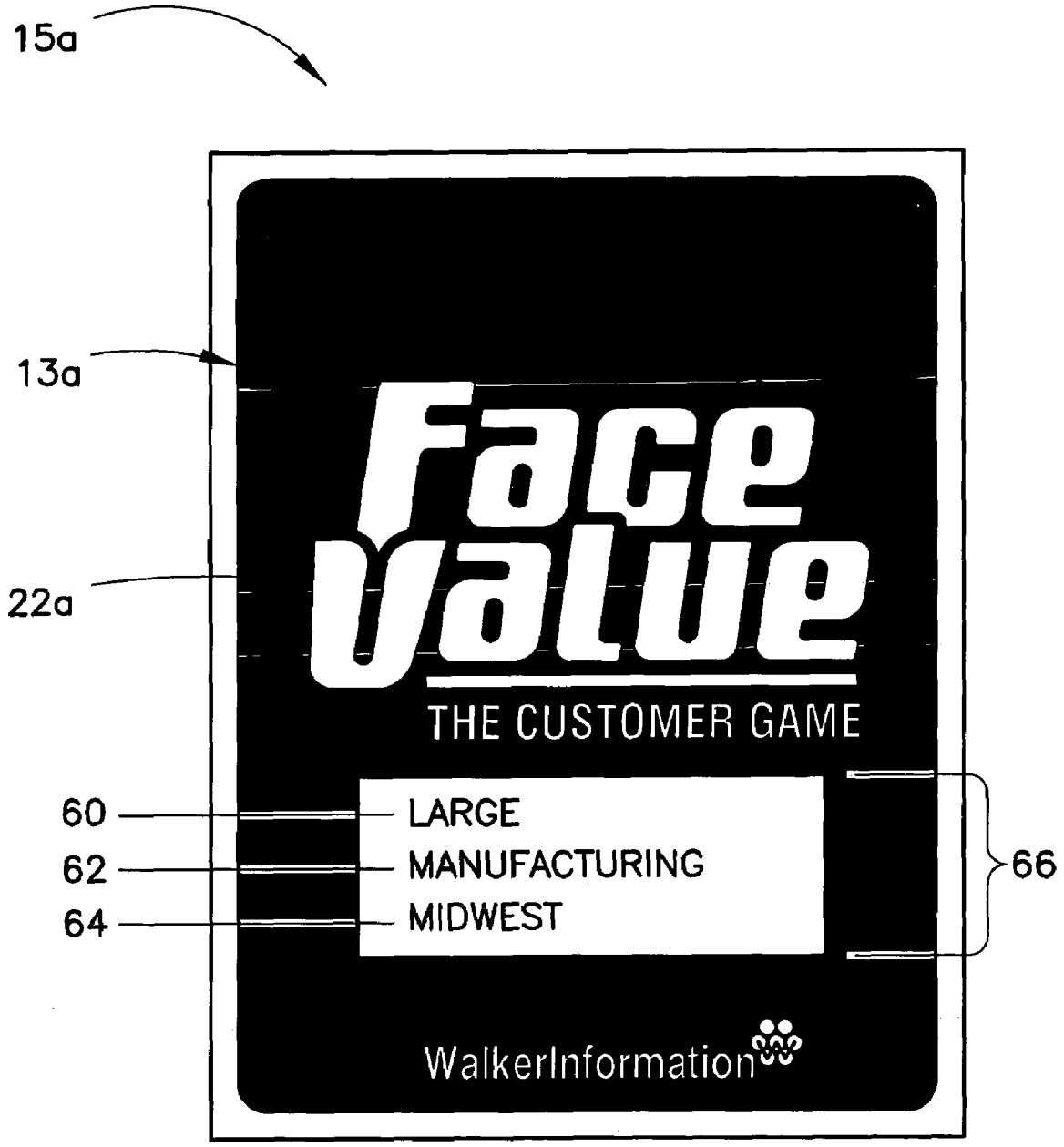
FIG. 2*a* is similar to FIG. 2, except

Optionally, additional customer information may be provided on the reverse side 13 of the playing card 15. In an illustrative embodiment, symbols (or words) identifying the size, industry, location, or other customer information are provided. Because the reverse side of the card is often visible to all players, such information may be provided for use in a version of the customer information card game where the players are permitted to choose a specific strategy for their companies. An illustrative reverse side including additional customer information 66 is shown in FIG. 2*a*, wherein size 60 is identified as LARGE, industry 62 is identified as MANUFACTURING, and location 64 is identified as MIDWEST. However, it is understood that FIG. 21 shows one illustrative example, and that various sizes, industries, and locations or names would be provided on each card. Further, in this embodiment, the customer information provided on the reverse side 13 of playing card 15 is customer information that identifies various aspects of that organization generally, whereas the types of customer information described above for the face side 11 of the playing card describe the specific interaction between the customer and the player's company. However, other arrangements are possible within the scope of this invention.

EXAMPLE I

Operation of an illustrative customer information card game is now described. A plurality of cards 15 as in FIGS. 1 and 2 are dealt to a plurality of players. This example uses three players, herein denoted as player1, player2, and player3. However, it is understood that any number of players may participate as long as there are sufficient numbers of playing cards. Also, two or more players may play together as a team or multiple games may take place simultaneously with a single facilitator. Player1 may be the dealer of the cards 15, who has possession of the cards at the beginning of the game. A facilitator is also present, who may or may not act as the dealer and may or may not take part in the game play. The facilitator knows the rules of the game or is provided with a set of the rules before the start of the game play. Ideally, none of the players know the rules before the start of the game play. Alternately, the game can be played without a facilitator, the instructions for each of the "rounds" of game play are hidden, and one of the players uncovers each of the instructions during the course of game play. The dealer deals five cards 15 to each of the players at the beginning of the game, and leaves the rest of the cards 15 in an active card pile with the reverse side 13 showing. The players are permitted to view the front of their own cards. At this time, each player is told that each player represents a company and each card represents a customer. The players are also told that the table represents a market and players represent competing companies within that market. Each player's "hand" of cards represents the company's customer base. The players may be told that the object of the game is to build and maintain the best customer base possible.

Round 1—Customer Revenue

The symbols located in first area 12 are explained to each of the players, as described more fully above. Each of the players, using this new information regarding the revenue brought by the customers, is permitted to discard up to three cards from his hand into a discard pile of cards, and each player then draws as many cards from the active pile as were discarded by that player. Illustratively, round 1 concludes with a discussion between the players of the effect the discard process had on their respective holdings.

Round 2—Customer Repurchase

The symbols located in second area 14 are explained to each of the players, as described more fully above. Each of the players, using this new information regarding whether their customers had repurchased goods or services, is permitted to discard up to three cards from his hand into a discard pile of cards, and each player then draws as many cards from the active pile as were discarded by that player. Illustratively, Round 2 concludes with a discussion between the players of the effect the new information and the discard process had on their respective holdings. During this discussion, the players may be asked to discuss their discard choices and how they valued the different indicators.

Round 3—Stealing Customers

Each of the players gets to "steal" a customer from one other player's hand. For example, in a three player scenario, player1 takes one of player2's cards and gives player2 one card from player1's own hand. The process is repeated between player2 and player3, and between player3 and player1. Round 3 concludes with a discussion between the players of the impact the "stealing" round had on the player's hands.

Round 4—Customer Service Calls

The symbols in third area 16 are explained to each of the players, as described more fully above. Each of the players, using this new information regarding calls to the customer service center, is permitted to discard up to three cards from his hand into a discard pile of cards, and each player then draws as many cards from the active pile as were discarded. Round 4 concludes with a discussion between the players of the effect the new information and the discard process had on their respective holdings. During this discussion, the facilitator may ask the players to comment on how each player viewed customer service calls.

Scoring Round 1

Figure 7:
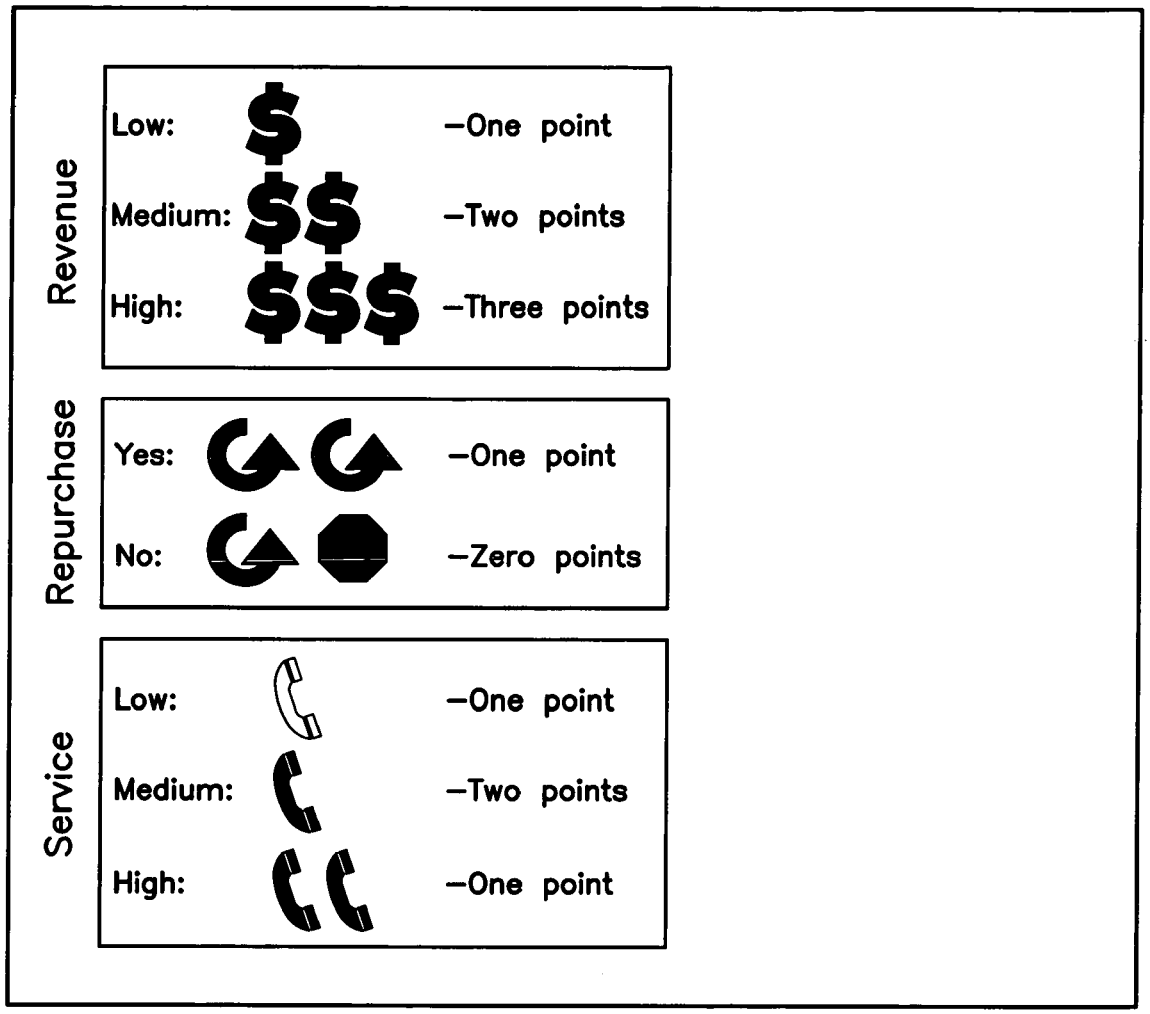
FIG. 7 is a list of the numerical values that may be assigned to each of the possible symbols in the first, second, and third areas of the card of FIG. 1.
Figure 8:
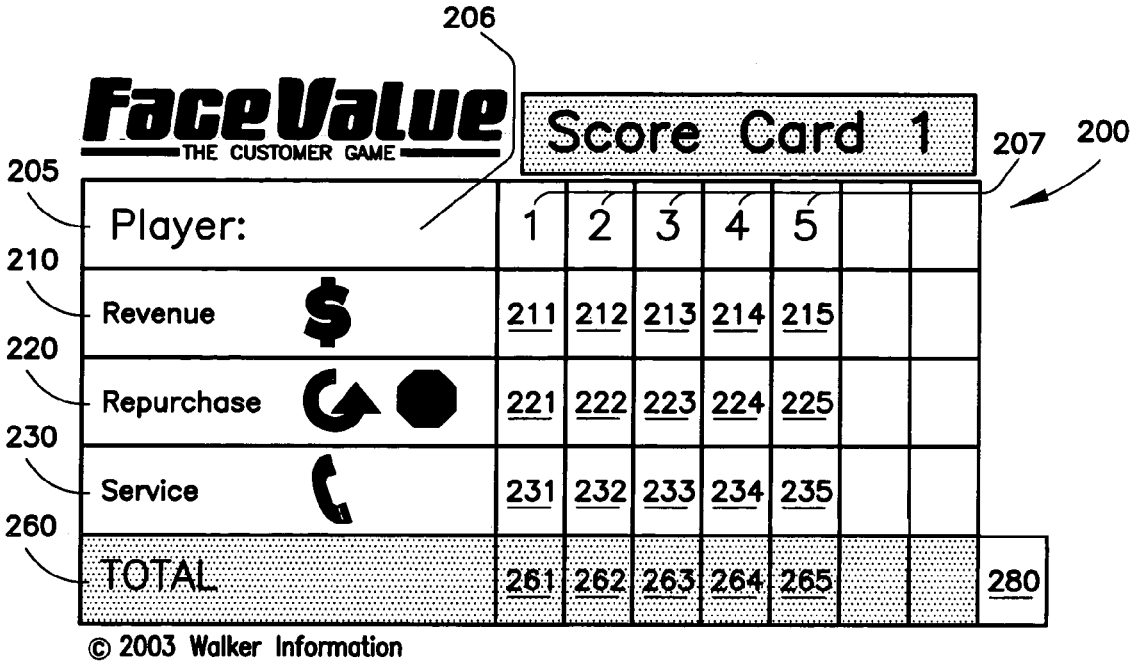
FIG. 8 is a score card used to total a player's score for the customer information card game.

Each of the players is provided with a first score card 200, as shown in FIG. 8, and compares the symbols for the first area 12, the second area 14, and the third area 16 on each of the cards in their hand with point values, as provided by the first point value sheet provided in FIG. 7. As shown in the score card 200 of FIG. 8, five rows are provided. The top row 205, provides a space 206 for the player's name and number indicators 207 for each card. The next row is the Revenue row 210, where the players can mark the point value for revenue for each of the cards. Five spaces 211 through 215 are provided. The Repurchase row 220 and the Service Calls row 230 similarly provide spaces 221 through 225 and 231 through 235, respectively, for marking these scores. The bottom row is the Total row 260, where the players can total the points for each card. Card totals 261 through 265 are then added together to obtain grand total 280, thus leaving each player with a single number to serve as a score. The players are allowed to compare scores and discuss their decision making. The player with the highest score and the player with the lowest score are identified.

Round 5—Mergers

The player with the highest point total and the player with the lowest point total from Scoring Round 1 are teamed up, and their companies merged into a single company. The teammates for the merged company then discard five cards so that their combined hand contains five cards. The teammates are permitted to use their knowledge about the customers in selecting cards to discard. Round 5 concludes with a discussion of the card selection process of the newly merged company.

Round 6—Customer Profit

The symbols in fourth area 18 are explained to each of the players, as described more fully above. Each of the players or teams, using this new information regarding profitability, is permitted to discard up to three cards from his hand into a discard pile of cards, and each player or team then draws as many cards from the active pile as were discarded. Round 6 concludes with a discussion between the players of the effect the new information and the discard process had on their respective holdings. During this discussion, the facilitator may ask questions about the players' decisions. The facilitator may also ask questions regarding additional information the players might want to have regarding the customers, including information regarding customer attitudes.

Round 7—Customer Loyalty

The colors of fifth area 20 are explained to each of the players, as described more fully above. The facilitator may provide information for each type of customer as follows:

Truly loyal (green) customers are most desirable. Such customers give favorable feedback on your products and services, and show a positive attitude toward your company. They plan to continue to do business with your company, and they are least vulnerable to any competitive offerings.

Accessible (yellow) customers give positive feedback on your company's products and services, but they indicate that they will not continue to do business with your company, perhaps due to a market condition of some sort.

Trapped (blue) customers are going to continue doing business with your company, but they are not happy about it. They are experiencing problems with your company, but something, perhaps a contract, is keeping them with you.

High risk (red) customers are not happy and will likely stop doing business with your company.

Each of the players, using this new information, is permitted to discard up to three cards from his hand into a discard pile of cards, and each player then draws as many cards from the active pile as were discarded. Round 7 concludes with a discussion between the players of the effect the new information and the discard process had on their respective holdings.

Round 8—Stealing Customers

Each of the players gets to "steal" a card from one other player's hand, with a restriction that a player cannot "steal" a customer that is "Truly Loyal." Before the stealing commences, each player places the cards for his truly loyal customers face down on the table. In a three player scenario, player1 then takes one of player2's card and gives one of player1's card to player2. The process is repeated between player2 and player3, and between player3 and player1. If any of the players holds five cards that each indicate the company is "Truly Loyal," then that player is skipped in this round. Round 8 concludes with a discussion between the players of the effect the "stealing" round had on any of the player's hands.

Scoring Round 2

Figure 10:
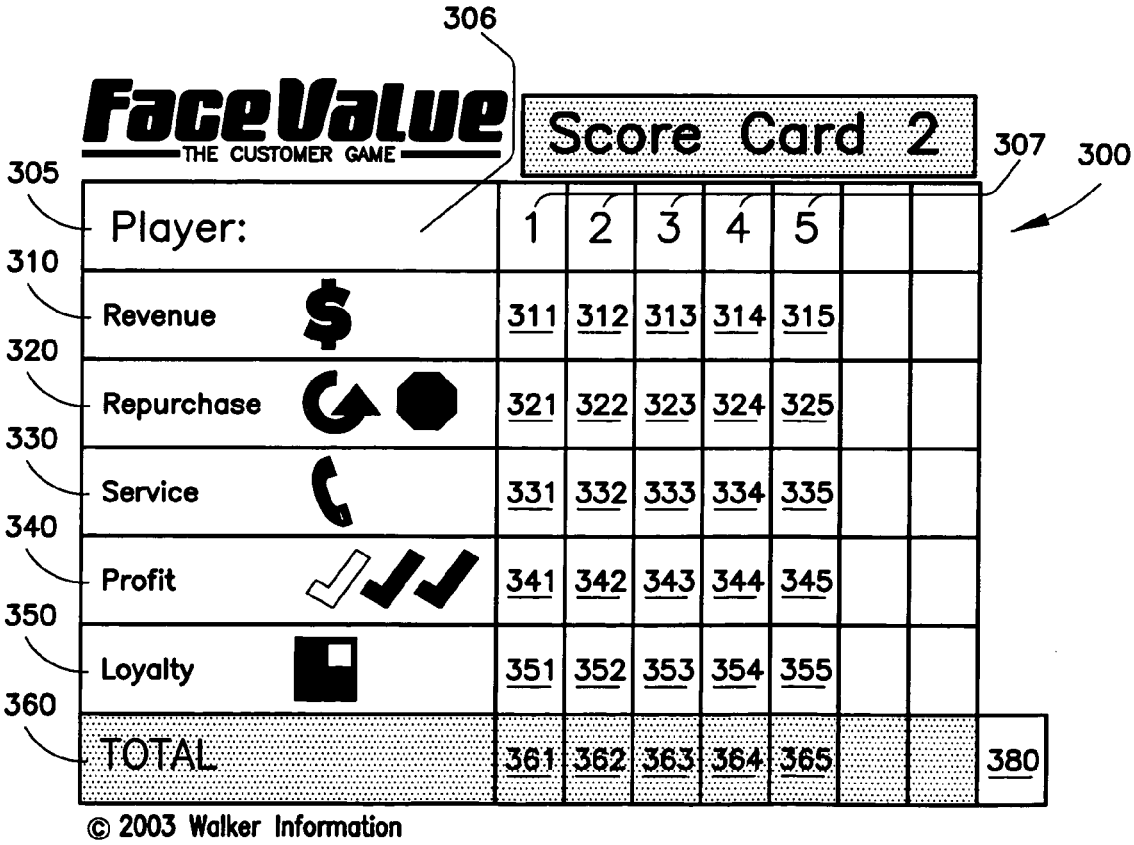
FIG. 10 is a score card used to total a player's score for the customer information card game.
Figure 9:
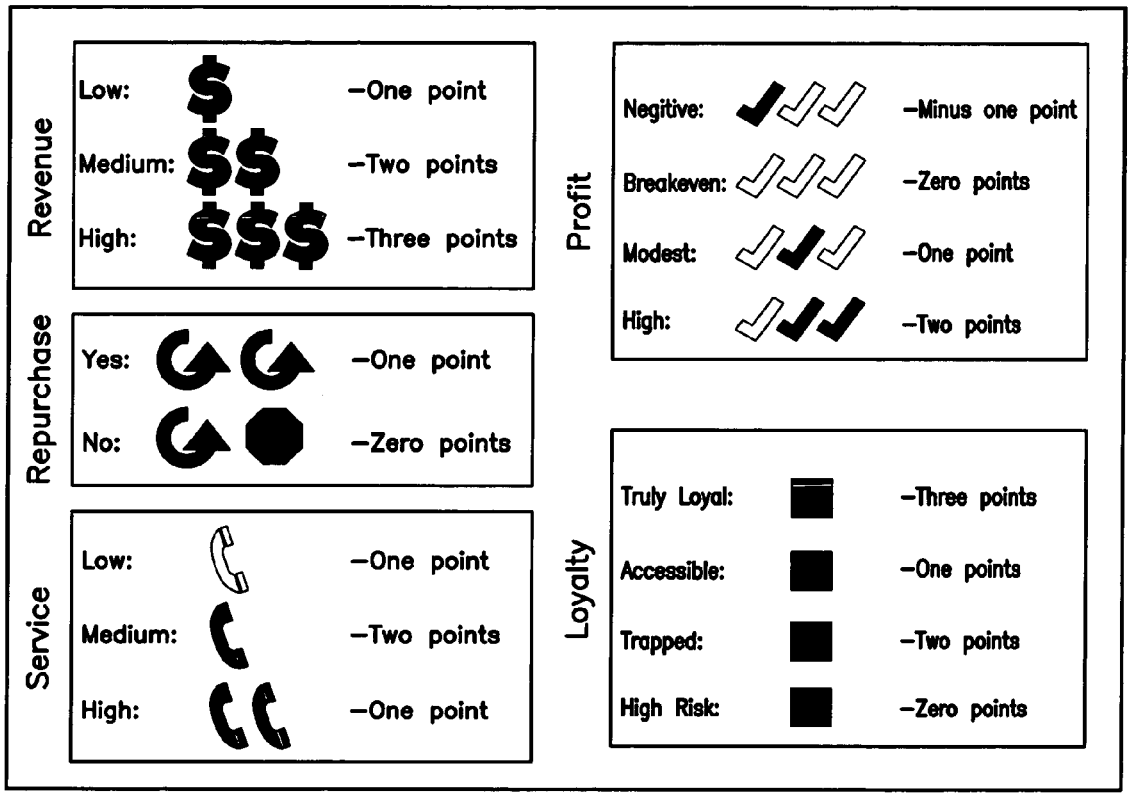
FIG. 9 is a list of the numerical values assigned to each of the possible symbols in the first, second, third, fourth, and fifth areas of the card of FIG. 1.

Each of the players is provided with a second score card, as shown in FIG. 10, and compares the symbols for the first area 12, the second area 14, the third area 16, the fourth area 18, and the fifth area 20 on each of the cards in their hand with point values as provided by the second value sheet, shown in FIG. 7. As shown in the score card 300 of FIG. 10, seven rows are provided. As with the first score card 200, the top row 305, provides a space 306 for the player's name and number indicators 307 for each card. The Revenue row 310, the Repurchase row 320, and the Service Calls row 330, with spaces 311 through 315, 321 through 325, and 331 through 335, respectively, are also similar to their counterparts in the first score card 200. Two additional rows are provided, the Customer Profit row 340 and the Loyalty row 350, with corresponding spaces 341 through 345 and 351 through 355. The bottom row is the Total row 360, where the players can total the points for each card. Card totals 361 through 365 are then added together to obtain grand total 380, thus leaving each player with a single number to serve as their final score. The point values for each of the cards is recorded on the second score card 300 and totaled, leaving each player with a single number score 380.

Illustratively, a discussion follows. In one embodiment, the facilitator may invite the two players with the highest scores to debate each other as to which player is holding the best hand. The other players may then vote to determine the winning hand. The discussion may include discourse on whether the winning hand was the hand with the highest score. The facilitator may also include discussion on analogizing the game to the business world. Illustrative topics include any or all of the following concepts: whether companies have the right information, whether companies are effectively using the information they have, whether more information means better decision making, how customer information may affect resource allocation, whether the needed information is different for different companies, and how the different types of client information may be valued. The game concludes with scoring Round 2 and the subsequent discussion.

EXAMPLE II

In another embodiment, the game may be played with the companies competing with each other in a competitive marketplace. Each company is given a choice of strategy for its business and companies may choose customers based on industry information. The game cards 15 in this example have the additional customer information 66 printed on the reverse side 13. In this embodiment, groups of players may play together as teams, with each team representing a company. However, it is understood that individual players may represent their own companies and play against each other.

Round 1—Company Strategy

In this round, the teammates discuss possible company strategies. Illustrative strategies include high volume/high revenue company, mid-sized niche company, and high profitability, but other strategies may be available. Each team then selects a strategy. In one embodiment, each team informs the facilitator of the choice of strategy, but does not inform the other teams.

Round 2—Customer Acquisition

In this round, each company builds its customer base. Each team is given as set number of game cards 15, illustratively 20 game cards. This is the company's initial customer base. The teams are encouraged to look at their customer base. The teams are then informed that additional customers are available. A number of game cards 15, illustratively 50 game cards are placed face down on the table, so that the additional customer information 66 on the reverse side 13 is visible. The teams then tell the facilitator which cards each team would like to have. A selection process then takes place. Optionally, a "dance card" matching system can be employed, or teams may take turns selecting a game card 15. If a matching system is used, each team may be given a few tokens (not shown) that can be used to increase the team's chances of obtaining a particular card. Once the teams receive their additional game cards 15, the game moves to the next round.

Round 3—Customer Revenue

The symbols located in the first area 12 are explained to each of the teams, as described more fully above. Using this new information on customer revenue, each team is presented with several options. In this embodiment, for each customer, the team may keep the card, discard the card, or trade the card. Illustratively, trading is done with the game cards 12 face down, such that only the reverse side 13 is shown. The teams may be given a limit on the number of game cards 12 that each team can discard or trade. An illustrative limit is ten cards. Because team members discuss their decisions among themselves, the facilitator may choose to delay a full group discussion until the end of the game.

Round 4—Repurchase

The symbols located in the second area 14 are explained to each of the teams, as described more fully above. Using this new information regarding whether their customers had repurchased goods or services, each team is presented with several options for keeping, discarding, or trading cards, as discussed in Round 3.

Round 5—Stealing Customers

In this round, each team may steal cards from one other team. Illustratively, each team can steal up to five cards from the team to its left. The teams are given a set time, illustratively five minutes, to discuss strategy and make their selections. During this time, all game cards 12 are face down, with only the reverse side 13 showing. All teams may do their stealing simultaneously, or stealing can progress one team at a time.

Round 6—Customer Contact

The symbols located in the third area 16 are explained to each of the teams, as described more fully above. Using this new information regarding calls to the customer service center, each team is presented with several options for keeping, discarding, or trading cards, as discussed in Round 3.

Round 7—Customer Profitability

The symbols located in the fourth area 18 are explained to each of the teams, as described more fully above. Using this new information regarding calls to the customer service center, each team is presented with several options for keeping, discarding, or trading cards, as discussed in Round 3.

Round 8—Customer Loyalty

The colors located in the fifth area 20 are explained to each of the teams, as described more fully above. Using this new information regarding customer loyalty, each team is presented with several options for keeping, discarding, or trading cards, as discussed in Round 3.

Round 9—Summary

The teams are asked to evaluate the health of their company. They may be asked to make a statement to the other teams about the health of their company. The facilitator may also lead a discussion regarding the decision making process using each type of customer information if this was not done after each round. Illustratively, the facilitator may lead a discussion regarding the criteria used in the decision making for each card. Optionally, score cards are used similar to those used in Example I.

EXAMPLE III

Figure 11:
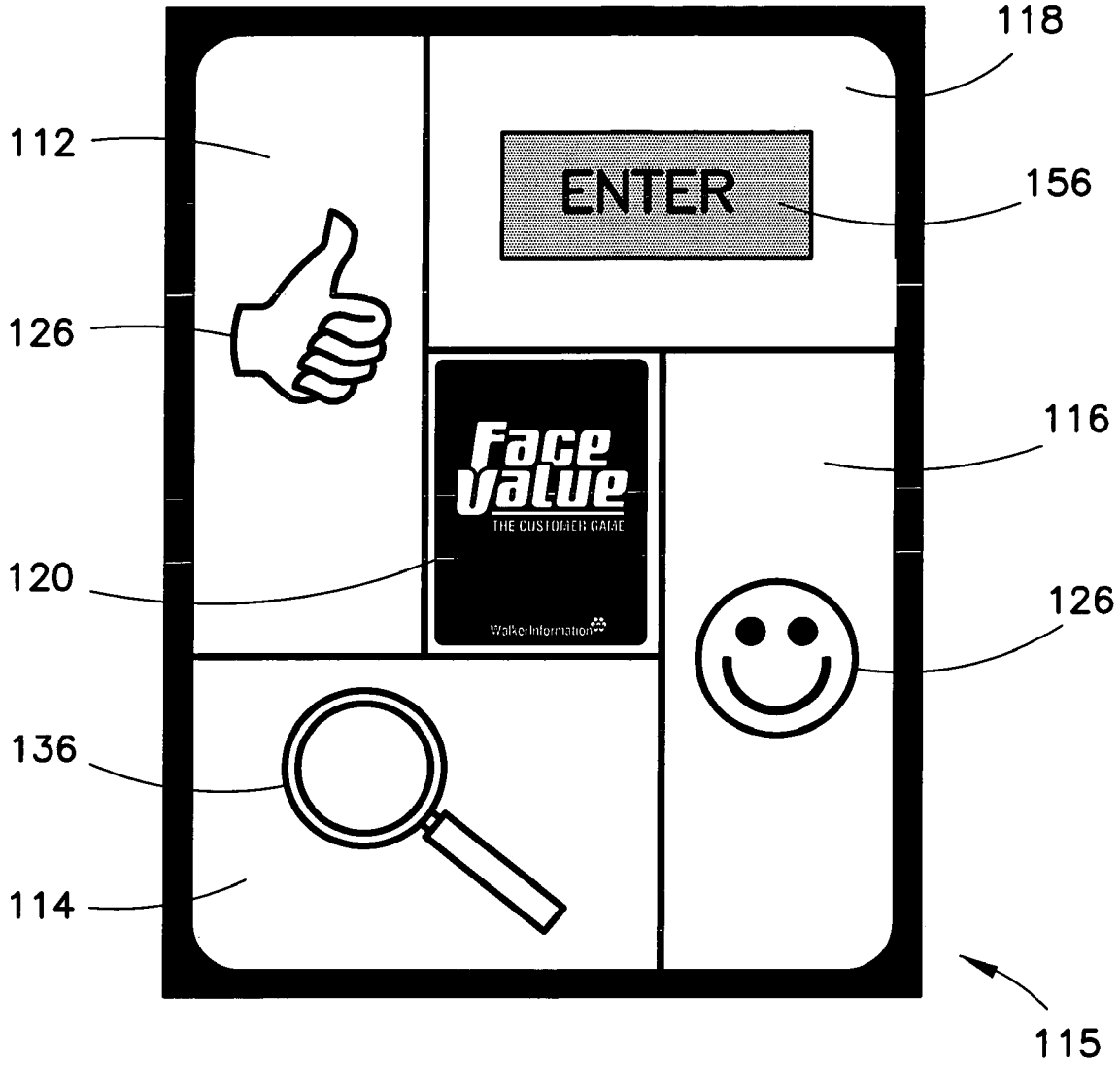
FIG. 11 shows a card for use in an audience participation version of the card game.

Customer information game cards may be used in a large group format, wherein each participant is given only one card and asked to sit or stand (or raise hands) based on information on the cards. In this embodiment, each card provides customer and/or employee information for a particular vendor. During each round, the facilitator may discuss the value of each piece of information. The facilitator may solicit audience participation in the discussion. A plurality of game cards 115, as shown in FIG. 11 is used in this Example. However, it is understood that a plurality of game cards 15, as discussed in Examples I and II, may be used.

Round 1

The audience is asked to look at first area 112. The audience members are asked to stand up if the thumbs-up symbol 126, as shown in FIG. 11, is present. A predetermined number, illustratively about 80-85% of the cards have this thumbs-up symbol; the rest of the cards have a corresponding thumbs-down symbol (not shown). The audience members standing are congratulated, as the percentage of the audience standing represents the percentage of customers in their company or industry that are satisfied or very satisfied with their current relationship with the vendor and/or it competitors. The audience is told that overall, it appears that customers are overwhelmingly satisfied. The audience is then asked to sit down.

Round 2

The audience is then asked to look at second area 118. The symbol will either be the ENTER sign 156, or a similar EXIT sign (not shown). The audience is asked to stand if they have the ENTER sign 156. Illustratively, about 65-75% will stand. The audience is told that this represents the percentage of customers that intend on continuing with their current vendors, and that it appears that three-quarters of the customers will be retained. The audience is asked to look at fifth area 120, and those who have blue cards are asked to sit down, while those who have green cards are asked to remain standing. Illustratively about 30-35% of the participants will remain standing. The audience is told that the ones standing are considered to be loyal customers, while the others that just sat down were only staying with their vendor because they are trapped in the relationship. The audience is asked to sit down.

Round 3

The audience is then asked to look at third area 114, and the magnifying glass 136. The audience is told that some of the magnifying glasses 136 are clear, as shown in FIG. 11, and some are cracked (not shown). The audience members are asked to stand if theirs is clear, and approximately 40% will stand. This represents that less than half of customers consider their vendors to be customer focused. The audience is asked to sit down.

Round 4

The audience is asked to look at fourth area 116. The audience is asked to stand if they have a smile face 146, as shown in FIG. 11, or neutral face (not shown). Illustratively, more than half of the audience will stand, the rest have a frown face (not shown). The audience is told that the number standing represents the percentage of employees in the industry that are planning on staying with their current company for the next two years. Then, those standing are asked to sit down if they have the neutral face. Illustratively, only 20-25% will remain standing. The audience is told that those standing represent the employees that are staying because they want to stay. Those that sat down are staying because they really do not see anyplace else to go, similar to the trapped customers. The audience is asked to sit.

As mentioned above, each round involves discussion of the information presented on the cards.

It is understood that the above description includes illustrative embodiments only and variation is possible. For example, the order of the rounds is illustrative only. While certain rounds work better before others, the order of many of the rounds is not important. Further, some of the rounds may be omitted, as is appropriate for a given group of players, or additional rounds added, illustratively additional merger and/or stealing rounds or rounds with additional customer information. It is also understood that a different order of rounds may require a corresponding adjustment in scoring. Additionally, the number of cards presented to each participant at the beginning of the game is illustrative only, and the game may be started with a different number of cards per participant. Similarly, where discarding and/or stealing cards is allowed, the various rounds may permit the players to discard and/or steal more or fewer of the cards in their hands, as appropriate. Furthermore, a different scoring system may be used to provide different values to the various client information symbols. As another example, the number and/or percentage of certain types of cards and/or types of customer information on certain cards for any given deck of cards may be customized to reflect typical markets and industries based upon industry statistics (e.g., for one industry the deck of cards may include 50% truly loyal cards and in another industry the deck of cards may only include 25% truly loyal customers).

Although other advantages may be found and realized and various modifications may be suggested by those versed in the art, it is understood that the present invention is not to be limited to the details given above, but rather may be modified within the scope of the appended claims.

The invention claimed is:

1. A method of playing a card game for assessing customer information comprising the steps of:

(a) providing a plurality of game cards, each game card having a face and a reverse side, each game card having printed thereon at least one type of customer information indicator related to a customer of a company that provides goods or services to the customer and a customer loyalty indicator indicative of the customer's loyalty to the company;

(b) dealing a selected number of the game cards to each of a group of players;

(c) identifying the meaning of each of a first set of indicators for a first of the types of customer information;

(d) allowing the players to discard unwanted game cards and receive a corresponding number of additional game cards;

(e) identifying the meaning of each of the customer loyalty indicators;

(f) providing a score for each of the indicators of the first sets and for each of the customer loyalty indicators; and (g) totaling the scores for each player by totaling the score for each card held by that player to yield a total score for each player.

2. The method of claim 1 further comprising the steps of:

(a) identifying the meaning of each of a second set of indicators for a second of the types of customer information; and (b) allowing the players to discard unwanted game cards for a second time and receive a corresponding number of additional game cards.

3. The method of claim 2 wherein the second type of customer information is repurchase information.

4. The method of claim 3, further comprising the step of identifying the meaning of each of a third set of indicators for a third of the types of customer information, wherein the third type of information is service calls information.

5. The method of claim 4, further comprising the step of identifying the meaning of each of a forth set of indicators for a third of the types of customer information, wherein the forth type of information is profitability information.

6. The method of claim 1 wherein the first type of customer information is revenue information.

7. The method of claim 1, further comprising the step of allowing each player to steal a card from another player.

8. The method of claim 1, further comprising the step of forming a team of the player having the highest score with the player having the lowest score by merging the cards of the player having the highest score with the player having the lowest score and allowing the team to discard half of their cards.

9. The method of claim 1, further comprising the step of having the players discuss decisions made.

10. A method of teaching the importance of customer loyalty to a plurality of players comprising the steps of:

providing a plurality of game cards, each game card representing a customer, each game card having a face side and a reverse side, the face side comprising a plurality of segregated areas, each segregated area populated with a different at least one customer information indicator printed thereon, the face side further comprising a customer loyalty indicator indicative of the loyalty of the customer to the company that provides goods or services to the customer, the customer loyalty indicator arranged on the face side to be contiguous to at least one of the plurality of segregated areas instructing the players to make decisions to discard game cards and obtain additional game cards based on the at least one customer information indicator printed on each respective game card;

identifying the meaning of the customer loyalty indicator printed on each respective card; and facilitating discussion about the effect of the at least one customer information indicator and customer loyalty indicator on the players' decision making.

11. The method of claim 10 wherein the step of instructing players to make decisions to obtain additional game cards involves taking cards from other players.

12. The method of claim 10 wherein the at least one customer information indicator includes customer revenue information.

13. The method of claim 10 wherein the at least one customer information indicator includes customer repurchase information.

14. The method of claim 10 wherein the at least one customer information indicator includes customer contact information.

15. The method of claim 10 wherein the at least one customer information indicator includes customer profitability information.

16. The method of claim 10 wherein the plurality of segregated areas comprise a first area, a second area, a third area, a fourth area, and a fifth area, the first through fourth areas populated by at least one symbol indicative of the at least one customer information indicator.

17. The method of claim 16 wherein the fifth area includes the customer loyalty indicator.

18. The method of claim 16 wherein each symbol and each customer loyalty indicator has an associated value, the set of playing cards further comprising a scorecard for providing a total value for the player.

19. The method of claim 10 wherein at least one card further comprises at least one customer information indicator printed on the reverse side.

20. The method of claim 19 wherein the customer information indicator printed on the reverse side is different from the customer information indicator printed on the face side.

* * * * *